US005151627A

United States Patent [19]

Van Nes et al.

[11] Patent Number: 5,151,627

[45] Date of Patent: Sep. 29, 1992

[54] CATHODE RAY TUBE HAVING STRONG DISPLAY WINDOW AND DISPLAY DEVICE

[75] Inventors: Johannes C. A. Van Nes; Johannes Penninga, both of Eindhoven, Netherlands

[73] Assignee: U.S. Philips Corporation, New York, N.Y.

[21] Appl. No.: 653,954

[22] Filed: Feb. 8, 1991

[30] Foreign Application Priority Data

Feb. 12, 1990 [NL] Netherlands ..... 9000325

[51] Int. Cl.[5] ..... H01J 31/00; H01J 29/86

[52] U.S. Cl. ..... 313/477 R; 313/408; 220/2.1 A

[58] Field of Search ..... 313/477 R, 408; 220/2.1 A, 2.3 A

[56] References Cited

U.S. PATENT DOCUMENTS

| | | | |
|---|---|---|---|
| 4,535,907 | 8/1985 | Tokita et al. | 313/477 R |
| 4,537,322 | 8/1985 | Okada et al. | 313/477 R |
| 4,590,404 | 5/1986 | D'Amato | 313/477 R |
| 4,881,004 | 11/1989 | Inoue et al. | 313/477 R |

*Primary Examiner*—Palmer C. DeMeo

*Assistant Examiner*—Nimeshkumar D. Patel

*Attorney, Agent, or Firm*—Paul R. Miller

[57] ABSTRACT

A cathode ray tube comprising a rectangular display window whose thickness increases from the center of the display window along the long and the short axes. The thickness D (x) of the display window along the long axis (x) is defined by:

$$D(x)=D_O+\Delta(x);$$

the thickness D(y) of the display window along the short axis (y) is defined by:

$$D(y)=D_O+\Delta(y);$$

where $D_O$ is the thickness at the center of the window, and $\Delta(y)$ is larger than $1.5\Delta(x)$. The display window thus formed combines a large strength with a relatively low weight. The invention is of particular importance in cathode ray tubes having a length: width ratio which is larger than 4:3, for example 16:9, and in large (≧28 inch) tubes.

22 Claims, 4 Drawing Sheets

CATHODE RAY TUBE HAVING STRONG DISPLAY WINDOW AND DISPLAY DEVICE

BACKGROUND OF THE INVENTION

The invention relates to a cathode ray tube comprising an at least substantially rectangular display window, a display screen provided on an inner surface of the display window and an electron gun.

The invention also relates to a display device comprising a cathode ray tube.

The strength of the display window is an important aspect of a cathode ray tube. It determines the implosion safety of the cathode ray tube. Further, the weight of the cathode ray tube is an important factor, in particular for large cathode ray tubes. In general, the aim is to obtain a strong display window having a relatively low weight.

OBJECTS AND SUMMARY OF THE INVENTION

One of the objects of the present invention is to provide a colour display device having a strong display window of a relatively low weight.

For this purpose, the cathode ray tube according to the invention is characterized in that the thickness $D_x$ of the display window along the long (x) axis is defined by:

$$D_x = D_0 + \Delta(x)$$

and the thickness $D_y$ of the display window along the short (y) axis is defined by:

$$D_y = D_0 + \Delta(y).$$

where $D_O$ is the thickness of the display window in the center of the display window and $\Delta(x)$ and $\Delta(y)$ are the increases in thickness along the long (x) axis and the short (y) axis, respectively, for which it holds that:

$$\Delta(y)_{max} > 1.5\Delta(x)_{max}.$$

The invention is based on the insight that it is advantageous to have a much larger increase in thickness of the display window along the short axis than along the long axis. Thus, a satisfactory implosion safety in combination with a relatively low weight of the cathode ray tube can be obtained.

Preferably, the thickness of the display window, measured along the diagonal, is defined by:

$$D_d = D_0 + \Delta(d),$$

where $\Delta(d)$ is the increase in thickness along the diagonal (d), for which it holds that:

$$0.8\Delta(y)_{max} < \Delta(d)_{max} < 1.2\Delta(y)_{max}.$$

In this case, the thickness of the display window along the upper and the lower edges is approximately constant. By virtue thereof, a larger implosion resistance at a relatively low weight can be attained.

An advantage of the cathode ray tube according to the invention, the cathode ray tube having a color selection electrode arranged in front of the display screen, is that an improvement of the images produced can be attained.

A phenomenon which occurs in such a cathode ray tube is that the intensity of the image produced is not uniform throughout the display window. This has several causes. The transmission of the colour selection electrode is not uniform but, viewed from the center of the color selection electrode, generally decreases towards the edges. The display window is curved, so that to the viewer the intensity decreases toward the edges of the display window. The invention provides a cathode ray tube of the type described in the first paragraph, which at least partly overcomes the above problem.

The glass used for the display window partly absorbs the light emitted by the display screen. In the case of a cathode ray tube of the type mentioned in the opening paragraph, the thickness of the display window increases both along the short axis and along the long axis, viewed from the center of the display window. In a cathode ray tube according to the invention, the decrease in intensity of light emitted by the cathode ray tube, as a result of absorption by the glass, is much less along the long axis than along the short axis. This has a positive effect on the uniformity of the intensity of light emitted by the cathode ray tube. The decrease in intensity caused by the other abovementioned factors is generally larger along the long axis than along the short axis.

An embodiment of the cathode ray tube according to the invention is characterized in that for each point p of at least a part of the short axis, the part being bounded by the end of the short axis, there is the following relation between the radius of curvature $R_{ix,p}$ in a direction transverse to the short axis at the inner surface and the radius of curvature $R_{ex,p}$ in a direction transverse to the short axis at the outer surface:

$$R_{ix,p} < R_{ex,p}.$$

Viewed from the short axis in a direction transverse to the short axis, the thickness of the display window in this part of the short axis decreases. Thereby an even larger implosion resistance at a relatively low weight can be attained. In addition, a positive effect on the uniformity of the intensity of light emitted by the cathode ray tube is obtained.

In an embodiment, the thickness of the display window exhibits a maximum value on the short axis at the end of the axis. Calculations have shown that the largest forces occur at the end of the short axis. The cathode ray tube according to the invention is strongest in those locations where the largest forces occur.

In the case of at least substantially rectangular display windows, the stresses occurring in the display window are larger at the end of the y-axis than at the end of the x-axis. Within the framework of the invention, it has been found that with respect to the static stresses occurring in the cathode ray tube, the most suitable ratio $\Delta y_{max}/\Delta x_{max}$ depends to a certain extent on the ratio $L_x/L_y$, where $L_x$ and $L_y$ are the lengths (from center to edge) of the x and y axes, and increases as this ratio increases.

The invention is of particular importance in a cathode ray tube in which $L_x$:$L_y$ is larger than 4:3. In an embodiment of the cathode ray tube according to the invention, $L_x$:$L_y$ is at least substantially equal to 16:9.

$\Delta(y)_{max}$, $\Delta(x)_{max}$ and $\Delta(d)_{max}$ will occasionally also be denoted as $\Delta_y$, $\Delta_x$ and $\Delta_d$ hereinafter.

BRIEF DESCRIPTION OF THE DRAWING

The invention will be explained in greater detail by means of a few embodiments of the color display device according to the invention and with reference to the accompanying drawings, in which.

The Figures are diagrammatic representations and are not drawn to scale, corresponding parts in the various embodiments generally bearing the same reference numerals.

DESCRIPTION OF THE PREFERRED EMBODIMENTS

Figure 1:
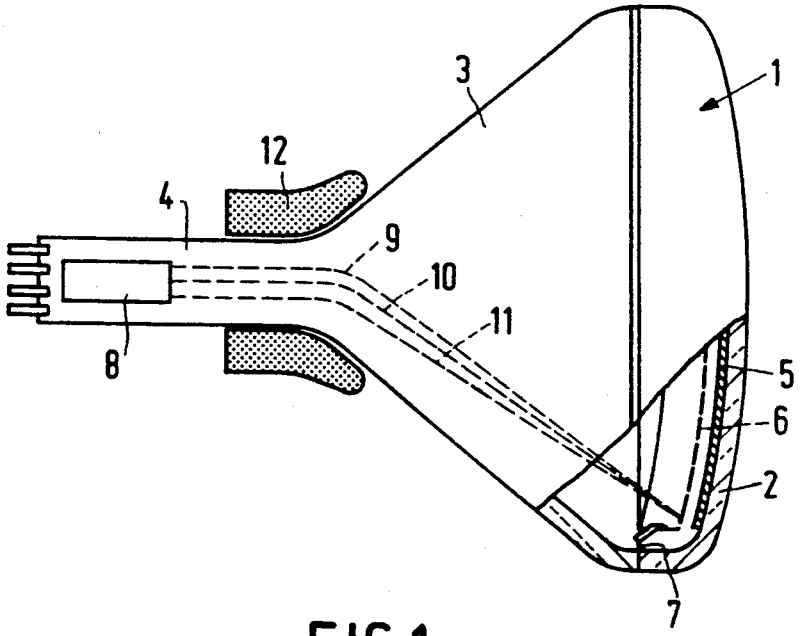
FIG. 1 is a sectional view of a color display device according to the invention.

FIG. 1 is a sectional view of a display device according to the invention. This display device comprises a cathode ray tube 1 having an envelope with a substantially rectangular display window 2. The envelope further comprises a cone 3 and a neck 4. A pattern of phosphors 5 luminescing in blue, red and green is provided on the display window 2.

A substantially rectangular color selection electrode 6 having a large number of apertures is suspended at a short distance from the display window 2 by suspension means 7 located near the corners of the color selection electrode.

An electron gun 8 for generating three electron beams 9, 10 and 11 is arranged in the neck 4 of the color display device. Said beams are deflected by a deflection system 12 and intersect each other substantially at the location of the color selection electrode 6, after which each of the electron beams impinges on one of the three phosphors provided on the screen.

Figure 2:
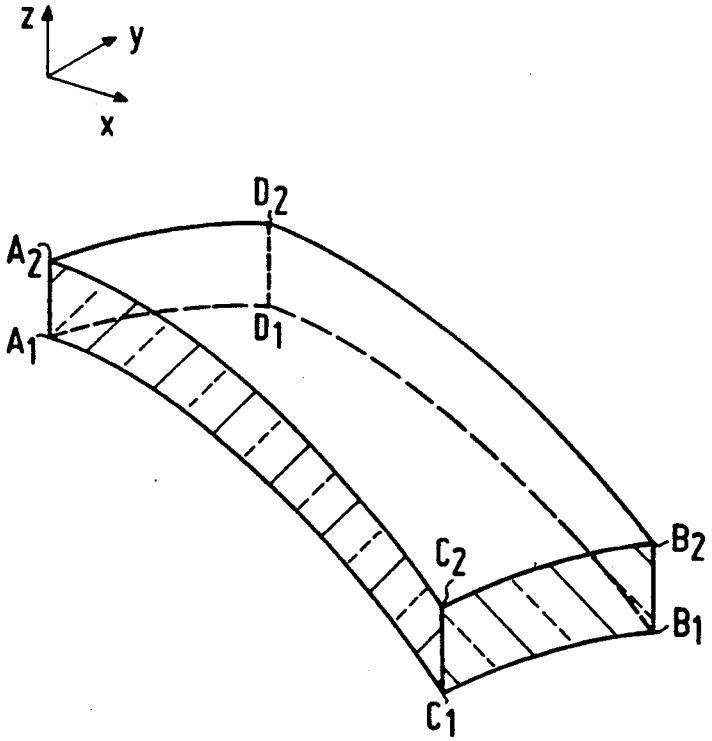
FIG. 2 is a partly perspective top view of a portion of a display window suitable for a cathode ray tube according to the invention.

FIG. 2 is a partly perspective top view of a part, in this drawing a quarter, of a display window suitable for use in a cathode ray tube according to the invention. The point A1 denotes the center of the inner surface of the display window. The point A2 denotes the center of the outer surface of the display window. The long axis is referred to as x-axis and the short axis is referred to as y-axis. The direction perpendicular to both the x-axis and the y-axis is referred to as the z-axis. In an example, the length of the long axis is 332 mm and the length of the short axis is 188 mm, which corresponds to a length: width ratio of approximately 16:9. The point B1 is the corner of the inner surface of the display window. The point B2 is the corner of the outer surface of the display window. The points C1 and C2 indicate-the end of the long axis for the inner surface and the outer surface, respectively. The points D1 and D2 indicate the end of the short axis for the inner surface and the outer surface, respectively. The points B1, B2, C1, C2, D1 and D2 are located where the front of the display window joins the edge of the display window, the transition from front to edge usually referred to as the R/r transition.

Figure 3:
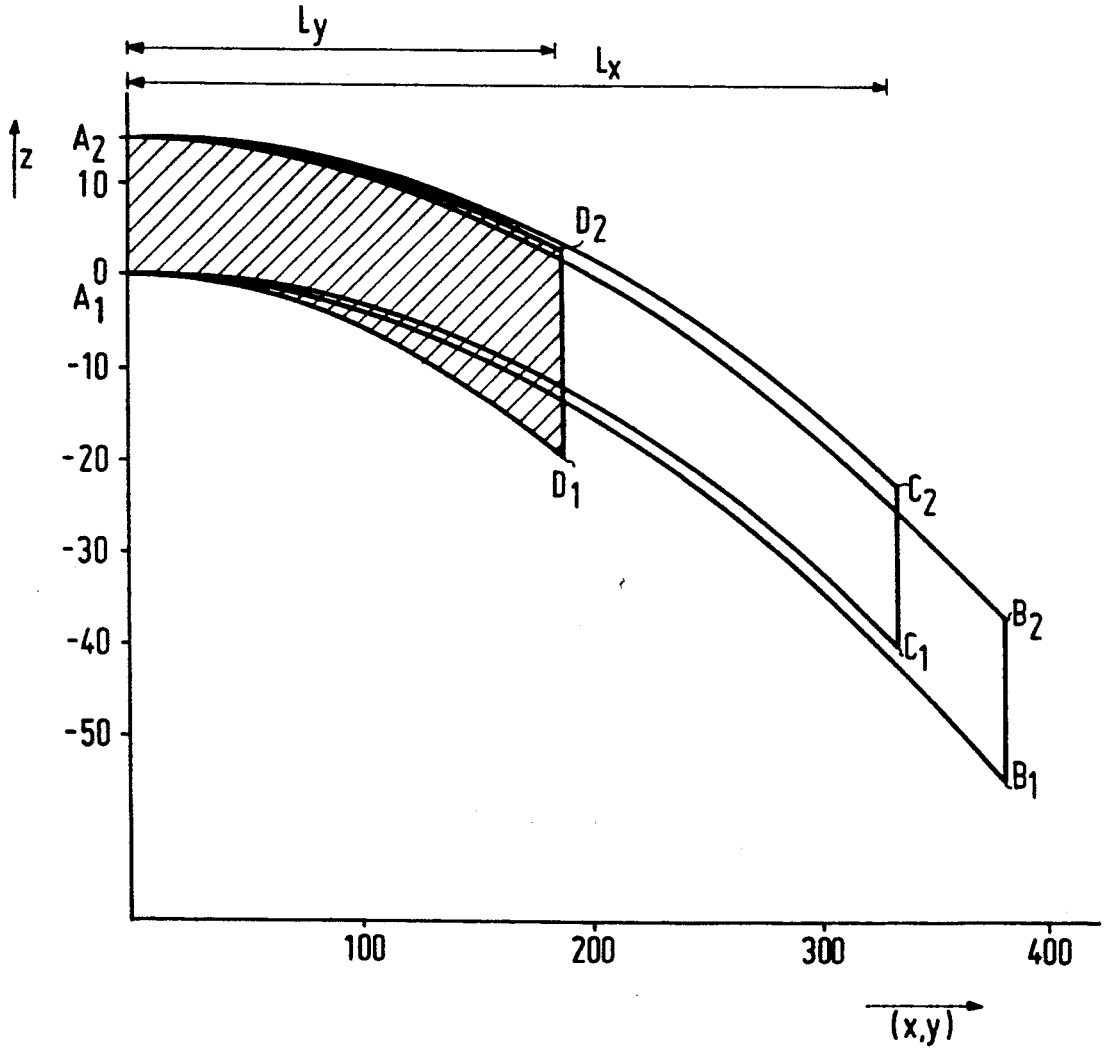
FIG. 3 is a graph of z versus (x, y) dimensions of several sections of a display window suitable for a cathode ray tube according to the invention.

FIG. 3 is a graph of z versus (x, y) dimensions for three sections of the display window shown in FIG. 2. The sections of the display window are shown for three planes, namely for the plane through the points A1, A2, C1 and C2 (along the x-axis), for the plane through the points A1, A2, D1 and D2 (along the y-axis) and for the plane through the points A1, A2, B1 and B2 (along the diagonal). The distance between the points A1 and C1 is $L_x$. The distance between the points A1 and D1 is $L_y$. The thickness $D_x$ of the display window along the long axis (x-axis) is defined by:

$$D_0+\Delta(x)$$

and $D_y$ along the short axis (y-axis) by:

$$D_0+\Delta(y).$$

$D_0$ is the thickness of the display window in the center and equals the distance between the points A1 and A2. The values $\Delta(x)$ and $\Delta(y)$ indicate the increase in thickness of the display window along the long (x) axis and the short (y) axis as a function of the x-coordinate and the y-coordinate, respectively.

The value $\Delta(x)_{max}$ is equal to the distance between the points C1 and C2 minus $D_0$ and, in the present example, is approximately equal to 1.33 mm. The value $\Delta(y)_{max}$ is equal to the distance between the points D1 and D2 minus $D_0$ and, in the present example, is approximately equal to 2.82 mm.

The display window is considerably thicker at the end of the short axis, that is, $\Delta(y)_{max} > 1.5\Delta(x)_{max}$. By virtue thereof, a satisfactory implosion safety can be obtained at a relatively low weight. In the case of at least substantially rectangular display windows the stresses occurring in the display window are larger at the end of the y-axis than at the end of the x-axis. The difference in stresses increases according as the ratio between the lengths of the x-axis and the y-axis increases. Consequently, the color display tube according to the invention is particularly suitable for cathode ray tubes having an aspect ratio larger than 4:3, for example, and at least substantially equal to 16:9, as in the example of FIG. 3.

The thickness of the display window along a diagonal is preferably defined by:

$$D_0+\Delta(d)$$

where $\Delta(d)$ is equal to the increase of the thickness of the display window along the diagonal. The value $\Delta(d)_{max}$ is equal to the difference between the distances between the points B1 and B2 and A1 and A2. It has been found that a satisfactory strength of the display window can be obtained at a ratio $\Delta(d)_{max}$: $\Delta(y)_{max}$ of approximately 1, for example between 0.8 and 1.2. In the example of FIG. 3, $\Delta(y)_{max}$ is 2.82 mm and $\Delta(d)_{max}$ is 2.77 mm. Thus, the ratio $\Delta(d)_{max}$: $\Delta(y)_{max}$ is approximately 1, in this example 0.98. The invention is of particular importance in cathode ray tubes in which the ratio $L_x$:$L_y$ is larger than 4:3, in the example of FIG. 3 the ratio $L_x$:$L_y$ is at least substantially equal to 16:9. In another example, $L_x$=376.4 mm, $L_y$=211.7 mm, $\Delta(y)$-

$_{max}$=3.44 mm, $\Delta(x)_{max}$=2.06 mm and $\Delta(d)_{max}$=3.16 mm. In the latter example, $L_x:L_y$=16:9, $\Delta(y)_{max}:\Delta(x)_{max}$=1.67:1 and $\Delta(d)_{max}:\Delta(y)_{max}$=0.92:1. It has further been found that in the case of a display window according to the invention, the outer edge of the display window is to be of a flat construction, that is, having a relatively small curvature. This has a positive effect on the weight of the cathode ray tube.

Figure 4:
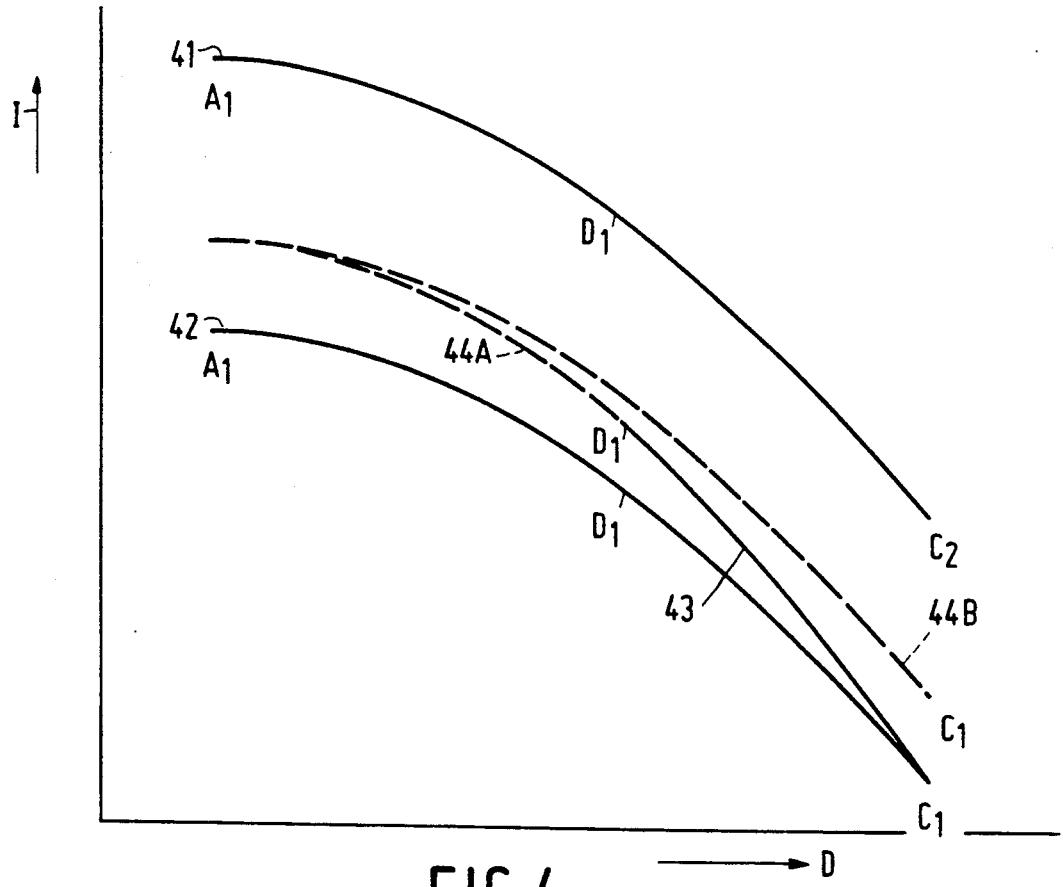
FIG. 4 shows the intensity of light emitted by the cathode ray tube as a function of the distance to the center of the display window, by means of which a further advantage of the invention is illustrated.

FIG. 4 shows a further effect of the invention. In this Figure, the intensity I of light emitted by the cathode ray tube is plotted in the vertical direction in arbitrary units. The distance D from the center of the display window is plotted on the horizontal axis. Curve 41 is an example of a typical variation in intensity of a cathode ray tube of the prior art, which can be ascribed to the construction of its color selection electrode. The intensity decreases as the distance from the center of the display window increases. In this example, it is assumed that the intensity decreases quadratically as a function of the distance from the center of the display window. Curve 42 shows the effect of a display window having a uniform thickness. As a result of absorption by the glass, the intensity has decreased at a substantially constant value. Curve 43 shows the effect of a display window, the thickness of the glass of which decreases from the edges to the center of the display window. The average intensity increases, which is favorable; the total weight of the display window decreases, which is also favorable; but the variation in intensity increases. This has a negative effect. The human eye is sensitive to differences in intensity. Curves 44A and 44B show the variation in intensity for a cathode ray tube according to the invention. The glass is thicker at the end of the y-axis than at a point on the x-axis which is at an equal distance from the center of the display window and it is even thicker than at the end of the x-axis. Curve 44A shows the variation in intensity along the y-axis and curve 44B shows the variation in intensity along the x-axis. It is obvious that the variation in intensity has decreased. The invention thus makes possible a favorable combination of image quality, strength and weight of the panel.

Figure 5:
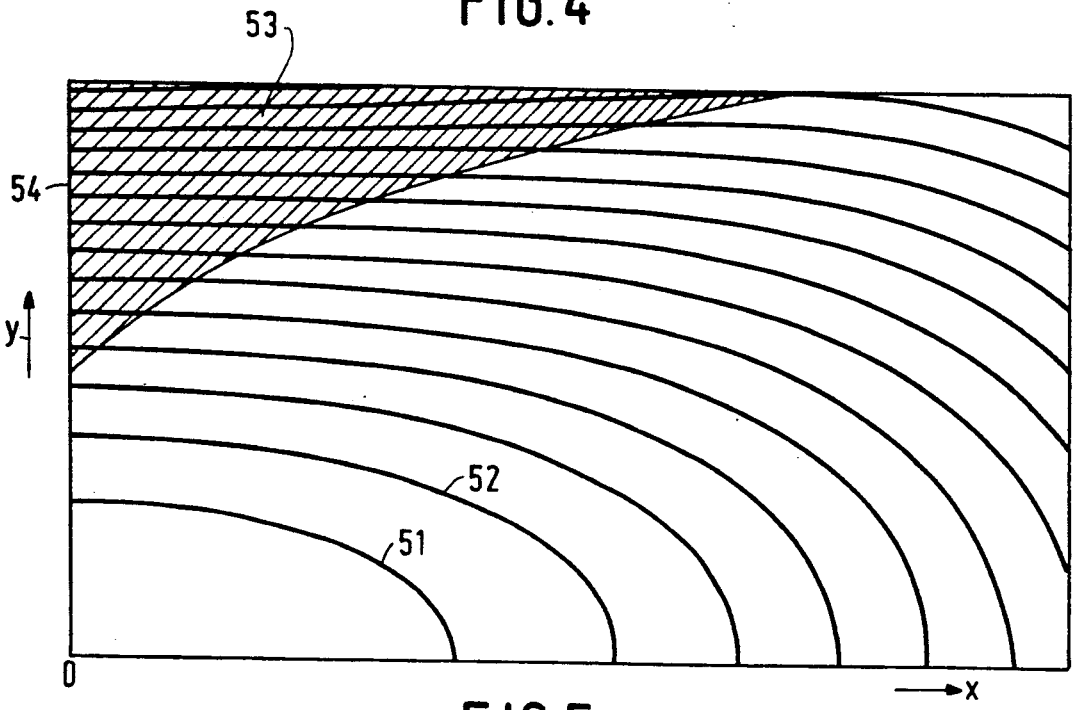
FIG. 5 is a top view of a quadrant of a window suitable for a cathode ray tube according to the invention, on which lines of equal thickness are drawn.

FIG. 5 is a top view of the display window quadrant shown in FIG. 2. In this Figure, lines of equal thickness representing the display window are drawn. The thickness at the center of the display window is approximately 15 mm. Each contour line represents a 0.2 mm increase in thickness. Thus, line 51 indicates a 0.2 mm larger thickness, line 52 indicates a 0.4 mm larger thickness, etc. The thickness of the display window increases both along the x-axis and along the y-axis. The display window is thicker at the end of the y-axis than at the end of the x-axis. FIG. 5 also shows an aspect of a further embodiment of the invention. For an area 53 of the display window, indicated in FIG. 5 by means of hatching, and comprising the portion 54 of the short (y) axis, it holds that:

$$R_{ix,p}<R_{ex,p}.$$

Where $R_{ix}$ and $R_{ex}$ are the radii of curvature transverse to the short axis at the inner and outer surfaces, respectively, and the subscript p denotes the y-coordinate of a point in the area 53. In this area the thickness of the display window does not increase as a function of the distance from the y-axis, but decreases instead. This has a positive effect on the uniformity of light emitted by the color display device. It is additionally possible to further reduce the weight of the color display device without increasing the risk of implosion. Preferably, the thickness of the display window exhibits a maximum value at the end of the y-axis. This aspect of the further embodiment is also of particular importance in color display tubes having an aspect ratio larger than 4:3, for example 16:9.

Figure 6:
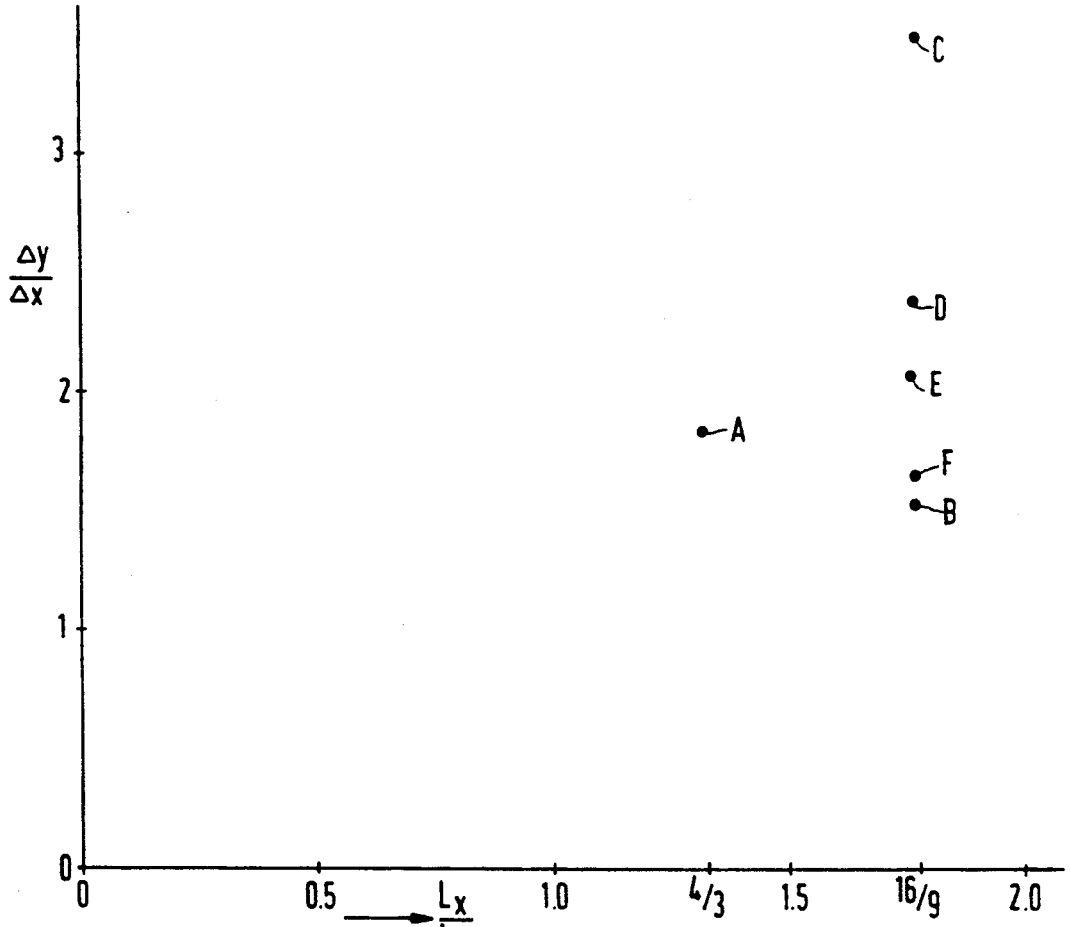
FIG. 6 is a graphic representation of $\Delta_y/\Delta_x$ as a function of $L_x/L_y$ for a number of display windows.

FIG. 6 shows the ratio $\Delta_y/\Delta_x$ as a function of the aspect ratio $L_x/L_y$. The points A, B, C, D, E and F represent windows for cathode ray tubes according to the invention, A being a window with 4/3 aspect ratio and a diagonal of 66 cm, B being a window with a 16/9 aspect ratio and a diagonal of 66 cm, C being a window with a diagonal of 76 cm, D being a window with a diagonal of 86 cm, E being the above-mentioned, first exemplary window with a diagonal of 76 cm and F being the above-mentioned, second exemplary window with a diagonal of 86 cm. For all points it holds that $\Delta_y/\Delta_x>1.5$. The spread of the values is a result of, on the one hand, the different sizes of the cathode ray tubes and, on the other hand, the fact that besides strength and transmission, further properties of the cathode ray tube may play a part such as, inter alia, reflection of light on the screen and doming of the color selection electrode. Calculations carried out within the framework of the invention show that with respect to the static strength of the cathode ray tube and the transmission, the most suitable ratio $\Delta_y/\Delta_x$ generally increases as $L_x/L_y$ increases. The invention is particularly suitable for cathode ray tubes for which it holds that $L_x/L_y>4/3$, for example 16/9.

Figure 7:
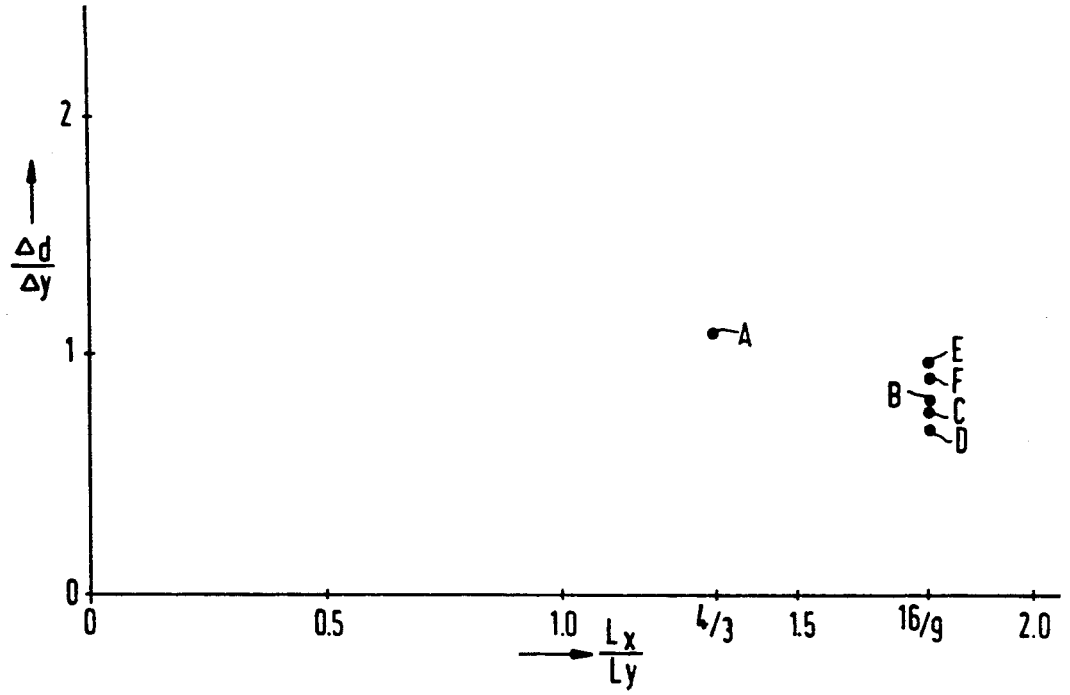
FIG. 7 is a graphic representation of $\Delta_d/\Delta_y$ as a function of $L_x/L_y$ for a number of display windows.

FIG. 7 shows as a function of $L_x/L_y$ the values of $\Delta_d/\Delta_y$ for the various display windows shown in FIG. 6.

Implosion safety and weight are important factors for, in particular, large cathode ray tubes, that is, cathode ray tubes having a diagonal equal to or larger than 28 inch.

It will be obvious that within the scope of the invention many variations are possible to those skilled in the art.

We claim:

1. A cathode ray tube comprising a display window, an electron gun and a display screen provided on an inner surface of the display window, characterized in that the thickness $D_x$ of the display window along the long axis is defined by:

$$D_x=D_O+\Delta(x)$$

and the thickness $D_y$ of the display window along the short axis is defined by:

$$D_y=D_O+\Delta(y),$$

where $D_O$ is the thickness of the display window in the center of the display window and $\Delta(x)$ and $\Delta(y)$ are the increases in thickness along the long (x) axis and the short (y) axis, respectively, for which it holds that:

$$\Delta(y)_{max}>1.5\Delta(x)_{max},$$

where $\Delta(x)_{max}$ and $\Delta(y)_{max}$ are maximum increases in thicknesses along the long (x) axis and the short (y) axis, respectively.

2. A cathode ray tube as claimed in claim 1, characterized in that the thickness $D_d$ of the display window along the diagonal is defined by:

$$D_d = D_O + \Delta(d).$$

where $\Delta(d)$ is the increase in thickness along the diagonal (d) and where:

$$0.8\Delta(y)_{max} < \Delta(d)_{max} < 1.2\Delta(y)_{max}.$$

where $\Delta(d)_{max}$ is the maximum increase in thickness along the diagonal (d).

3. A cathode ray tube as claimed in claim 1, characterized in that the cathode ray tube comprises a colour selection electrode arranged in front of the display screen.

4. A cathode ray tube as claimed in claim 1, characterized in that for each point p of at least a part of the short axis, which part is bounded by the end of the short axis, there is the following relation between the radius of curvature $R_{ix,p}$ in a direction transverse to the short axis at the inner surface and the radius of curvature $R_{ex,p}$ in a direction transversely to the short axis at the outer surface:

$$R_{ix,p} < R_{ex,p}.$$

5. A cathode ray tube as claimed in claim 4, characterized in that the thickness of the display window exhibits a maximum value on the short axis at the end of said axis.

6. A cathode ray tube as claimed in claim 1, characterized in that the aspect ratio $L_x$:$L_y$ is larger than 4:3, $L_x$ being the length of the long axis and $L_y$ being the length of the short axis from center to edge.

7. A cathode ray tube as claimed in claim 6, characterized in that $L_x$:$L_y$ is at least substantially equal to 16:9.

8. A cathode ray tube as claimed in claim 1, characterized in that the diagonal dimension of the display window is equal to or larger than 28 inches.

9. A display device comprising a cathode ray tube as claimed in claim 1.

10. A cathode ray tube as claimed in claim 2, characterized in that the cathode ray tube comprises a color selection electrode arranged in front of the display screen.

11. A cathode ray tube as claimed in claim 2, characterized in that for each point p of at least a part of the short axis, which part is bounded by the end of the short axis, there is the following relation between the radius of curvature $R_{ix,p}$ in a direction transverse to the short axis at the inner surface and the radius of curvature $R_{ex,p}$ in a direction transverse to the short axis at the outer surface:

$$R_{ix,p} < R_{ex,p}.$$

12. A cathode ray tube as claimed in claim 3, characterized in that for each point p of at least a part of the short axis, which part is bounded by the end of the short axis, there is the following relation between the radius of curvature $R_{ix,p}$ in a direction transverse to the short axis at the inner surface and the radius of curvature $R_{ex,p}$ in a direction transverse to the short axis at the outer surface:

$$R_{ix,p} < R_{ex,p}.$$

13. A cathode ray tube as claimed in claim 2, characterized in that the aspect ratio $L_x$:$L_y$ is larger than 4:3, $L_x$ being the length of the long axis and $L_y$ being the length of the short axis from center to edge.

14. A cathode ray tube as claimed in claim 3, characterized in that the aspect ratio $L_x$:$L_y$ is larger than 4:3, $L_x$ being the length of the long axis and $L_y$ being the length of the short axis from center to edge.

15. A cathode ray tube as claimed in claim 4, characterized in that the aspect ratio $L_x$:$L_y$ is larger than 4:3, $L_x$ being the length of the long axis and $L_y$ being the length of the short axis from center to edge.

16. A cathode ray tube as claimed in claim 5, characterized in that the aspect ratio $L_x$:$L_y$ is larger than 4:3, $L_x$ being the length of the long axis and $L_y$ being the length of the short axis from center to edge.

17. A cathode ray tube as claimed in claim 2, characterized in that the diagonal dimension of the display window is equal to or larger than 28 inches.

18. A cathode ray tube as claimed in claim 3, characterized in that the diagonal dimension of the display window is equal to or larger than 28 inches.

19. A cathode ray tube as claimed in claim 4, characterized in that the diagonal dimension of the display window is equal to or larger than 28 inches.

20. A cathode ray tube as claimed in claim 5, characterized in that the diagonal dimension of the display window is equal to or larger than 28 inches.

21. A cathode ray tube as claimed in claim 6, characterized in that the diagonal dimension of the display window is equal to or larger than 28 inches.

22. A cathode ray tube as claimed in claim 7, characterized in that the diagonal dimension of the display window is equal to or larger than 28 inches.

* * * * *